US005298301A

United States Patent [19]

Midgley et al.

[11] Patent Number: 5,298,301

[45] Date of Patent: Mar. 29, 1994

[54] ELECTRICAL INSULATOR

[75] Inventors: John Midgley, San Carlos, Calif.; David W. M. Thornley, Malmesbury, England

[73] Assignee: Raychem Limited, London, England

[21] Appl. No.: 852,196

[22] PCT Filed: Oct. 16, 1990

[86] PCT No.: PCT/GB90/01594

§ 371 Date: Apr. 15, 1992

§ 102(e) Date: Apr. 15, 1992

[87] PCT Pub. No.: WO91/06106

PCT Pub. Date: May 2, 1991

[30] Foreign Application Priority Data

Oct. 17, 1989 [GB] United Kingdom ..... 8923408

[51] Int. Cl.[5] ..... H01B 17/32

[52] U.S. Cl. ..... 428/34.9; 428/36.4; 428/36.91; 428/372; 428/379; 428/383; 428/398; 428/399; 174/211; 174/DIG. 8

[58] Field of Search ..... 174/137 A, 211, 209, 174/DIG. 8, 176, 177, 199; 428/34.9, 36.9, 36.4, 36.91, 375, 376, 379, 384, 383, 398, 399, 400

[56] References Cited

U.S. PATENT DOCUMENTS

| | | | |
|---|---|---|---|
| 3,950,452 | 4/1976 | Schmidt et al. | 260/859 |
| 4,008,205 | 2/1977 | Jones | 260/79.3 |
| 4,045,604 | 8/1977 | Clabburn | 428/36 |
| 4,173,670 | 11/1979 | VanAuken | 428/36 |
| 4,286,015 | 8/1981 | Yoshida et al. | 428/305 |
| 4,378,463 | 3/1983 | Senior et al. | 174/73 |
| 4,714,800 | 12/1987 | Atkins et al. | 174/73 R |
| 4,973,798 | 11/1990 | Parraud et al. | 174/176 |

FOREIGN PATENT DOCUMENTS

| | | |
|---|---|---|
| 0125884 | 5/1984 | European Pat. Off. . |
| 0147978 | 12/1984 | European Pat. Off. . |
| 0210807 | 2/1987 | European Pat. Off. . |
| 0430135 | 6/1989 | European Pat. Off. . |
| 2287755 | 10/1975 | France . |
| 1292276 | 9/1968 | United Kingdom . |
| 1292276 | 10/1972 | United Kingdom . |
| 1337951 | 11/1973 | United Kingdom . |
| 1337952 | 11/1973 | United Kingdom . |
| 1530994 | 11/1978 | United Kingdom . |
| 1530995 | 11/1978 | United Kingdom . |

OTHER PUBLICATIONS

J. Polymer Science, 1983, No. 70 pp. 129–143.

Encyclopedia of Polymer Science and Engineering, vol. 14, Reinfored Plastics.

*Primary Examiner*—Ellis P. Robinson

*Assistant Examiner*—Michael A. Williamson

*Attorney, Agent, or Firm*—Herbert G. Burkard; A. Stephen Zavell

[57] ABSTRACT

A high voltage insulator has a polymeric core that forms a mechanical strength member and an outer covering of a heat-shrinkable polymeric tube that is electrically insulating and non-tracking and that has sheds on its outer surface.

10 Claims, 1 Drawing Sheet

ELECTRICAL INSULATOR

FIELD OF THE INVENTION

The present invention relates to an electrical insulator, and in particular to an insulator formed from polymeric material.

Typically, insulators are formed from an elongate body of electrically insulating material such as porcelain, with or without the addition of an outer polymeric component, or from glass fibre covered by a polymeric component. Metal fittings are mounted at each end for connection to electrical equipment at elevated voltage (typically greater, and often much greater than 1 kV) and (usually) earth respectively. The outer surface may be shedded and/or convoluted, so as to prevent water flowing directly between the end fittings and also so as to extend the creepage path length.

In the case of a solid porcelain insulator, the sheds and/or convolutions can be provided integrally with the porcelain core. Alternatively, a cylindrical porcelain rod of uniform diameter may have a polymeric component of shedded and/or convoluted configuration mounted thereon. Due to the poor electrical and water uptake properties of glass fibre, when an insulator core is provided from such material an outer protective component is necessary, and this can conveniently be provided by a shedded and/or convoluted polymeric component.

Porcelain is a traditional insulator material, and is still preferred in some applications because of its superior resistance to damage by electrical discharges, to weathering, and to chemical attack. However, it is relatively heavy, and is a brittle material which can shatter on impact; in this respect, the convolutions or sheds are particularly vulnerable. Furthermore, porcelain has a high surface free energy, which makes it retentive to dirt. Its manufacturing process requires firing in a kiln, and this is not conducive to the easy manufacture of complex shapes. It is, however, not an expensive material to manufacture into an insulator.

Polymeric insulators in general are suitable for many applications, and are widely and successfully used, especially in view of their low weight, particularly in relation to porcelain or other ceramic materials, and their resistance to pollution, under most severe conditions, for example at higher voltages and in adverse operating conditions, particularly of heavy environmental pollution. Furthermore, polymeric materials will usually maintain their mechanical integrity if subjected to mechanical abuse, and are relatively easy to form into complex shapes.

One example of a polymeric insulator is disclosed in British Patent No. 1292276, and comprises a central support, which may be a glass fibre rod or tube, having a metal fitting at each end and an outer surface layer formed from a heat-shrinkable non-tracking insulating polymeric sleeve that extends the entire length of the support and overlaps each end fitting.

A further advantageous form of electrical insulator is disclosed in EP-B-0125884, which comprises an insulator that is a hybrid between a porcelain insulator and a polymeric insulator. This insulator combines the advantages of the structural strength of porcelain to form the insulator core, on the ends of which metal connection fittings are mounted, with the advantages of lightness, formability and mechanical (especially vandal) resistance of polymeric material to form an outer component. The outer component is spaced apart along the procelain core from the metal end fittings to avoid degradation of the polymer at such locations due to intense local electrical activity.

However, porcelain and hybrid insulators still suffer from the problems associated with the high density, and thus weight, of porcelain, and this disadvantage is also applicable to other ceramics such as glass. Insulator cores of fibreglass on the other hand are vulnerable to ingress of moisture which then, due to the glass fibres extending continuously from one end of the insulator to the other, wicks along the entire length of the insulator, forming a conductive path and destroying its operability. Furthermore, in applications involving telecommunication links and particularly at high frequency, any mechanical movement between the metal end fittings of the insulator and the associated electrical equipment can give rise to intermittent contacts that can generate electrical noise.

DESCRIPTION OF THE PREFERRED EMBODIMENT

Figure 1:
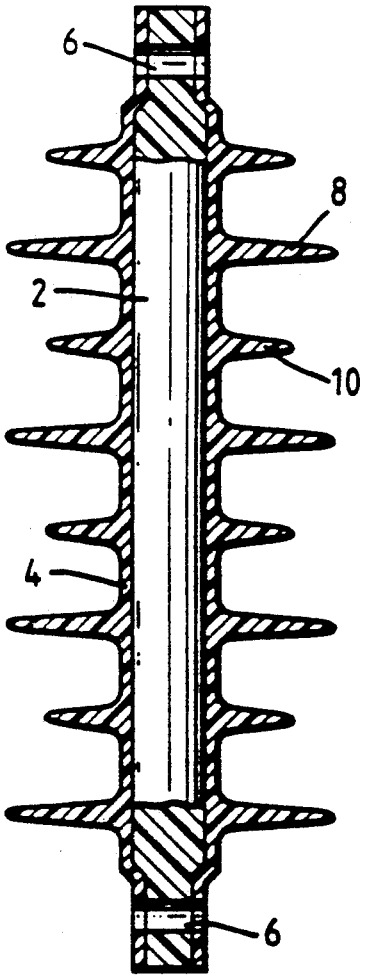
FIG. 1 illustrates a partial crossectional view of an insulator embodiment of the invention.

Accordingly, it is one object of the present invention to provide an electrical insulator that overcomes, or at leasst alleviates, some or all of the above-mentioned disadvantages.

In accordance with one aspect of the present invention, there is provided an electrical insulator comprising an outer component of generally tubular configuration formed from electrically insulating, substantially non-tracking, polymeric material, and an inner component formed from a substantially homogenous, non-hygroscopic, electrically insulating, polymeric material having a Flexural Modulus of at least about 0.5 GPa at 23° C.

Preferably the inner and outer components are discrete, and the outer component is mounted on the inner component.

This aspect of the invention thus provides a two-component insulator in which the inner component is of polymeric material chosen for its mechanical properties such that it is rigid enough to form a strength member and that is water resistant, and in which the outer component is of polymeric material chosen for its electrical properties in providing a non-tracking and weather-resistance outer surface. The material forming the inner component is such as not to require the metal end fittings that are needed with known insulators, since mechanical forces can be transferred to and from the inner component directly by drilling and tapping holes therein for example. Unlike an insulator having a fibreglass core there are no continuous reinforcing filaments that can be broken by such drilling, which would otherwise allow further opportunity for entry of water. Furthermore, due to the inherent properties of the material, there is no need to ensure, by means of conventional end fittings, that the planar end of the inner component are sealed against moisture ingress.

The Flexural Modulus of suitable materials for the inner component may lie within the range of about 0.5

GPa to about 20 GPa at 23° C. For some materials, it may be necessary, or desirable, to add reinforcing filler material to produce the required mechanical strength, and in such cases the filler may comprise chopped fibrous material, which may be glass for example. It will be understood that although the insulator of the present invention may thus contain fibres of glass, these are small in length, do not extend continuously from one end of the insulator to the other, and thus do not destroy its homogeneity, that is to say, there is no preferred orientation of the material of the inner component.

In general, the configuration of the insulator of the invention will be elongate, with the inner component being a cylindrical rod, and the outer component being mounted thereon so as substantially to enclose, and thus electrically protect, the entire outer surface of the inner component. Depending upon how the connection is made between the insulator and its associated electrical equipment, the, usually planer, end of the inner component may alternatively be of hollow tubular configuration, provided that each end is properly sealed so as to keep out water or other moisture.

Advantageously, the material of the inner component may be selected: reaction injection moulded polyurea: high density polyethylene; polyethyleneterephthalate; NORYL, a polystyrene modified polyphenyleneoxide available from General Electric Corporation; polyetheretherketone; polybutyleneterephthalate; polypropylene; polyethersulphone; and polyetherimide. The material of the inner component advantageously has a dielectric constant (permittivity) no greater than about 4, which is significantly less than the values (greater than 5) for procelain, glass or fibreglass. The inner component will thus have a relatively small capacitance, which means that the amount of radio noise generated is small. Such insulators are thus particularly suitable for use with radio antennae.

The following materials, with the Flexural Modulus of a corresponding rod (in GPa at 23° C.) given in brackets, are particularly suitable for use as the inner component of the insulator of the present invention: polyetheretherketone (PEEK) filled with 30% by weight of chopped glass fibres [10]; a compound of unfilled polyethersulphone or polyetherimide [2.6]; polyethylemeterephthalate (PET) filled with 50% or 30% by weight of chopped glass fibres [18.3, 11.3 respectively]; unfilled PET [2.5]; polypropylene filled with 30% by weight of chopped glass fibres [6.0]; unfilled polybutyleneterephthalate (PBT) [2.0]; high density polyethylene (HDPE) [1.0]; and reaction injection moulded (RIM) polyurea [0.5 - 0.1]. Such materials are suitable for use in the temperature range of −40° to +80° C., have a dielectric strength greater than 10 kV/mm, have low water absorption, and maintain good electric strength even when saturated with water.

For use outdoors and/or in contaminated environments, the outer surface of the insulator advantageously has a shedded and/or convoluted configuration. This can conveniently be achieved by providing the outer component in the form of article disclosed in GB-A-1530994, or GB-A-1530995, or EP-A-0147978, that is to say, a hollow article having an outer shedded and/or convoluted configuration. Such articles are recoverable by the application of heat thereto, but it is also envisaged that the outer component may be applied without the application of heat thereto, and may for example be an article of the kind disclosed in EP-B-0210807.

Alternatively, the outer component may be moulded in place on to the inner component.

Suitable head recoverable articles for use as the outer component of the insulator are available from Raychem under the designation 200S Parts. These parts are both weather resistant, i.e. have good resistance to ultra-violet radiation, ozone, salts and water, and are also non-tracking, i.e. comply with the ASTM D2303 inclined plane and IEC 112 comparative tracking index specifications. Examples of suitable materials for the outer component are disclosed in GB-A-1337951 and 1337952.

The entire disclosures of GB-A-1530994 (corresponding U.S. Pat. No. 4,045,604), GB-A-1530995 (corresponding U.S. Pat. No. 4,045,604), EP-A-0147978 (corresponding U.S. Pat. No. 4,714,800), EP-B-0210807 corresponding U.S. Pat. No. 4,868,967), GB-A-1337951 corresponding U.S. Pat. No. 4,399,064), and GB-A-1337952 (corresponding U.S. Pat. No. 4,521,549) are included herein by reference.

In another embodiment of the invention, the inner component, or strength member, can itself be formed in a shedded and/or convoluted configuration, and the outer component can be formed from a uniform tubular member. The uniform tubular member is then mounted on the inner component so as substantially to conform thereto. Advantageously, such conformity can be achieved by forming the outer component from a recoverable, for example heat-recoverable, tube of polymeric material of substantially uniform diameter and wall thickness, that is recovered on to the inner component.

It is also envisaged that in accordance with the invention an electrical insulator may be formed entirely from a homogeneous, electrically insulating, substantially non-tracking non-hygroscopic polymeric material that has a flexural modulus of at least about 0.5 GPa at 23° C. Thus the insulator may be formed from a single component that has the required mechanical and electrical properties. It will be appreciated that such an insulator may be formed from materials set out above or combinations thereof.

Insulators in accordance with the present invention will now be described, by way of example, with reference to the accompanying cross-sectional drawings.

Referring to FIG. 1, the 250 mm long insulator, which is suitable for use at 3 kV, comprises an elongate cylindrical rod forming an inner component 2 and a shedded tube forming an outer component 4. The inner component 2 of diameter 20 mm tapers sightly to a smaller diameter at each end, the taper serving further to secure the outer component 4 which has been recovered by heat into conformity with the inner component 2. A hole 6 of diameter 10 mm is drilled and tapped through both components at the reduced diameter ends to allow direct attachment of the insulator to its associated electrical equipment. The outer component 4 has a series of larger diameter sheds 8 alternating along the length of the insulator with a series of smaller diameter sheds 10, to give a total creepage distance of 650 mm.

Figure 2:
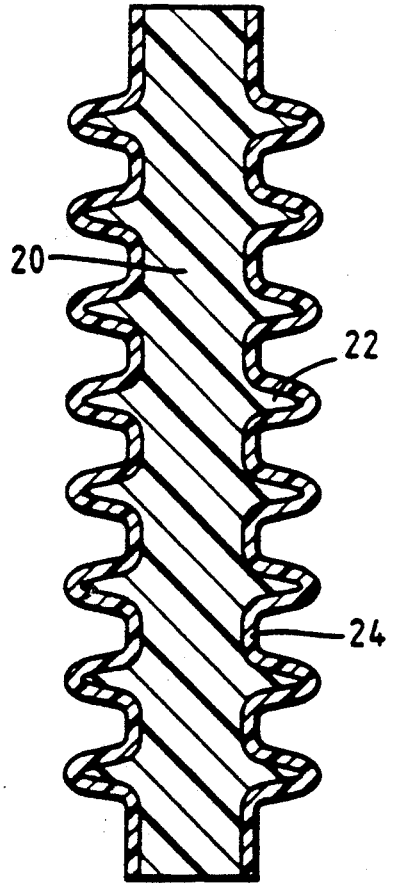
FIG. 2 illustrates a crosssectional view of an alternative insulator embodiment where the inner polymeric strength component is itself formed from a solid body.

Referring to FIG. 2, the inner polymeric strength component 20 of the insulator is itself formed from a solid body having sheds 22 formed integrally therewith. The outer component is provided by shrinking a hollow head-shrinkable tube 24 of uniform outer diameter over the core member 20 into conformity therewith.

We claim:

1. An electrical insulator comprising:

(a) an outer component, and
(b) an inner component, in which
(i) said inner component mechanically supports said outer component,
(ii) said outer component is of generally tubular configuration formed from electrically insulating, non-tracking weather resistant, polymeric material, and
(iii) said inner component is formed from a substantially homogeneous, non-hygroscopic, electrically insulating polymeric material having a Flexural Modulus of between 0.5 and 20.0 GPa at 23° C.

2. An insulator according to claim 1, wherein the inner component is a solid tubular member.

3. An insulator according to claim 2, wherein the polymeric material of the inner component is reinforced by a filler.

4. An insulator according to claim 3, wherein the reinforcing filler comprises chopped fibrous glass material.

5. An insulator according to claim 3, wherein the polymeric material of the inner component is selected from the group consisting of reaction injection moulded polyurea, high density polyethylene, polyethyleneterephthalate, polyetheretherketone, polybutyleneterephthalate, polypropylene, polyethersulphone and polyetherimide.

6. An electrical insulator according to claim 1, wherein the material of the inner component is selected so as to have a dielectric constant of no greater than about 4.

7. An insulator according to claim 1, wherein the outer surface of the outer component has at least one of a shedded and convoluted configuration.

8. An insulator according to claim 7, wherein the configuration of the outer component is provided by the configuration of the inner component.

9. An insulator according to claim 1, wherein the outer component substantially completely encloses the inner component.

10. An insulator according to claim 1, wherein the outer component is mounted on the inner component by being heat recovered into position.

* * * * *

UNITED STATES PATENT AND TRADEMARK OFFICE

CERTIFICATE OF CORRECTION

PATENT NO. : 5,298,301

DATED : Midgley et al

INVENTOR(S) : March 29, 1994

It is certified that error appears in the above-indentified patent and that said Letters Patent is hereby corrected as shown below:

Column 1, line 8, insert --Background of the Invention--.

Column 2, line 33, replace "leasst" by --least--.

Column 4, line 65, replace "head-shrinkable" by --heat-shrinkable--.

Column 6, Lines 2 & 3, replace "poluethyleneterephthalate" by --polyethyleneterephthalate--.

Signed and Sealed this

Fourth Day of October, 1994

*Attest:*

*Attesting Officer*

Bruce Lehman

BRUCE LEHMAN

*Commissioner of Patents and Trademarks*